United States Patent [19]

Rand et al.

[11] Patent Number: 4,993,055

[45] Date of Patent: Feb. 12, 1991

[54] ROTATING X-RAY TUBE WITH EXTERNAL BEARINGS

[75] Inventors: Roy E. Rand, Palo Alto; Douglas P. Boyd, Hillsborough; Kristian R. Peschmann, San Francisco, all of Calif.

[73] Assignee: Imatron, Inc., South San Francisco, Calif.

[21] Appl. No.: 275,780

[22] Filed: Nov. 23, 1988

[51] Int. Cl.[5] ..... H01J 35/10

[52] U.S. Cl. ..... 378/125; 378/137

[58] Field of Search ..... 378/125, 131, 132, 137

[56] References Cited

U.S. PATENT DOCUMENTS

| | | | |
|---|---|---|---|
| 2,209,963 | 8/1940 | Du Mond | 378/137 |
| 2,499,545 | 3/1950 | Van Der Tuuk | 378/125 |
| 4,788,705 | 11/1988 | Anderson | 378/125 |

*Primary Examiner*—Craig E. Church

*Attorney, Agent, or Firm*—Flehr, Hohbach, Test, Albritton & Herbert

[57] ABSTRACT

X-ray tube includes a rotatable envelope in which is mounted an electron gun at one end and a target anode at the other end. A fixed means for deflecting the electron beam from the electron gun is provided to deflect the electron beam on a fixed path as the envelope of the x-ray tube rotates about an axis. The electron beam being confined to a fixed path results in the electron beam striking various positions of the target anode to provide for improved heat dissipation. The electron beam is deflected along the fixed path using magnetic deflection means including magnetic deflection coils positioned external of the envelope to provide a deflection field transverse to the electron beam. The target anode is cooled by directing a cooling fluid on an external side of the target anode.

13 Claims, 3 Drawing Sheets

ROTATING X-RAY TUBE WITH EXTERNAL BEARINGS

BACKGROUND OF THE INVENTION

1. Field of the Invention

This invention relates to x-ray tubes and, more particularly, to high-power x-ray tubes having increased average power dissipation.

2. Prior Art

X-ray tubes have applications in two fields: medical x-ray diagnostic imaging and technical x-ray imaging. Medical imaging x-ray tubes are characterized as providing x-rays from a high brightness focal spot, and with a low duty-cycle. Technical x-ray tubes, which are used, for example, for non-destructive testing (NDT) are characterized as providing x-rays from a focus with lower brightness but with high duty-cycles. Most medical x-ray tubes use a rotating target anode enclosed within a vacuum envelope to achieve high peak brightness. The rotating anode is often a disk made from a high melting point metal, which is cooled by high-temperature radiation cooling. X-rays are generated by accelerating electrons onto the target (anode). The yield for x-ray generation is so low that about 99% of the electron beam power is converted into wasted heat energy. Failure to dissipate this heat results in a temperature rise which can irreversibly damage or destroy components of these expensive tubes. The efficiency of radiation cooling dramatically increases at higher temperatures so that efficient radiation cooling requires operation of the anode at high temperatures, which increases the conditions for and the likelihood of tube damage or failure. In contrast, technical x-ray tubes use a fixed target anode which can be cooled by direct contact with a cooling fluid, permitting high duty-cycles at low energy.

Medical x-ray tubes are used in computerized-tomography CT imaging systems as a source of high brightness, narrowly focused x-rays to precisely measure attenuation data, which then are "reconstructed" to form images for medical diagnosis. However, CT imaging systems, or scanners, have severe operational limitations imposed upon them due to the limited duty-cycles of the rotating anode x-ray tubes used in such CT imaging systems. In operation, because commercial x-ray tubes used in CT systems have very low duty-cycles, these CT systems must be used intermittently so that the x-ray tube can cool down to a safe operating temperature. For example, a typical abdominal scan requires 20,000 watts of electron beam power. Yet, the maximum power dissipation of a typical rotating-anode x-ray tube is in the range of 100 watts, with 2000 watts power dissipation being available for certain tubes employing an oil-recirculating heat-exchanger. This results in an effective duty cycle of 0.005 to 0.1, being careful not to exceed the maximum power dissipation temperature limits.

One component which is particularly subject to damage and failure is the bearing for supporting the rotating anode of the x-ray tube within the vacuum envelope. Typically, the anode disk is mounted at the end of a rotatable structure supported by the bearing. The bearing surfaces are contained with the vacuum of the tube. Because a typical lubricant would contaminate the vacuum enclosure, no such lubricants are used. Heat dissipation from a tube during high load conditions is provided primarily by radiation of thermal and optical radiation energy from the rotating anode disk to the walls of the envelope containing the vacuum for the tube. The walls of the envelope are composed of glass, metal, and/or ceramic materials and may be surrounded by a dielectric oil bath. For radiation cooling to be effective, the anode disk must be at an elevated temperature. During high loading conditions, the anode disk does get to a high temperature and cooling becomes more efficient. However, if the anode temperature is elevated for an extended period of time, the bearing gets too hot and its lifetime is dramatically reduced. With the advent of CT, the designs of existing rotating x-ray tubes were challenged. Bearings were redesigned to prevent movement of the focal spot, that is the region on the anode struck by an electron beam, as components of the tube expanded and contracted as the temperature of the tube changed. CT systems were particularly sensitive to movement of the focal spot on the target anode.

Another challenge to tube designers was to increase the number of CT scans before the tube had to be idled for cool-down. It appears that most tube and equipment manufacturers have chosen the same solution to this problem: Increase the heat capacity of the rotating anode structure. The amount of heat which can be stored in the anode up to its maximum allowed temperature is commonly called "heat-loadability" of the tube. Its value is commonly given in watt-seconds (joules) or in "heat units" (one joule is approximately 1.3 heat units). These solutions have involved increasing the diameter, size, weight, and surface emittance of the rotating anode disk, as well as using heat-exchangers for the oil-dielectric surrounding the vacuum envelope of these tubes. Not much progress has been made regarding the bearings contained within the vacuum.

Currently, the newest and largest heat capacity rotating x-ray tubes being commercially produced use heat exchangers and can dissipate approximately 3000 watts. Since continuous input powers of 20–30,000 watts are still desired, these x-ray tubes have a duty-cycle of approximately 10% and still must be kept idle for over 90% of the time. Actual operation at a power level of 3000 watts would reduce the life of their bearings to a few days or even hours. In addition, these tubes with their associated heat-exchangers are quite bulky and very expensive.

Even though x-ray tube designs have been incrementally improved, it still remains a problem that the type of x-ray tubes needed for CT still need to be idled once they have their thermal capacity loaded up by initial operation of the tube from a cold start. In the operation of a CT system, a certain amount of this type of idle time can be masked partially by whatever time is required to perform digital data processing and image reconstruction. As electronic computer processing systems become faster and less expensive, image reconstruction times become shorter and soon will be the same as the actual x-ray scanning time. Thus, the x-ray tube is the limiting factor when higher patient throughput is needed, for example, to improve the economic balance sheet of a facility, to cope with civil emergency situations, and to handle battlefield triage conditions.

Most technical x-ray imaging systems do not use rotating anode tubes. These systems use so-called stationary anode tubes, which are rugged tubes normally operated at up to a 100% duty cycle and which have substantial service lives. This type of tube has a stationary, liquid-cooled anode. However, their peak power is rated at only approximately 2% of the peak power of a rotating anode tube used in medical imaging systems. Since the focal spot remains stationary on the target anode, the power of a stationary anode tube is limited typically to 300 watts for an effective focal spot size of 1 by 1 millimeter to 50 watts for a 50 micrometer diameter focal spot size. For applications requiring high spatial resolution, a small focal spot is required and the tube power must be correspondingly reduced. Because their peak power is low, these tubes in addition to having severe limitations with respect to their spatial resolution capabilities, have limitations on the maximum allowed thickness of the object to be tested. Whereas digital image acquisition processing and display-methods have been introduced in medical imaging over the past 15 years, technical X-ray imaging is still mostly done with silver-based photographic film. One of the reasons that there is so little progress in digital X-ray imaging for technical application is believed to be the low brightness of the focal spot of stationary-ray tubes. For X-ray films this is not a problem because they are ideal integrators for x-ray photons and by simply increasing the exposure time (in some cases to as much as hours or longer), the low brightness of the technical tubes can be accounted for. Modern digital (electronic) imaging devices however require a certain minimum x-ray flux for recording because the signal level is required to be above the noise floor of the electronic x-ray detection device. An x-ray tube which would combine the high flux of a rotating tube with the high duty cycle of a stationary tube would make it possible for digital imaging to enter the field of technical x-ray imaging.

A number of improved bearings have been proposed for rotating anode x-ray tubes. Also, rotating x-ray tubes are available which use fluid-cooling of the rotating anode, such as, for example, tubes provided by Elliot of England and Rigaku of Japan. These tubes do combine the strong point of the rotating anode tubes (higher peak power capacity) with the strong point of the fixed anode tubes (direct fluid-cooling of the anode). However, these tubes are not used in medical imaging systems because the peak performance of these tubes is not equal to that provided by current rotating anode tubes. In addition, these tubes have another disadvantage which is that they are not hermetically sealed. The rotating shaft for the anode goes through the vacuum envelope via a rotary seal which uses a magnetic fluid with a low vapor pressure. The tube needs to be connected to a vacuum pump to maintain and/or establish a high vacuum within the envelope of the tube. This significantly increases the complexity and cost of an imaging system in addition to decreasing reliability.

SUMMARY OF THE INVENTION

It is therefore an object of the invention to provide an x-ray tube which has an improved average power dissipation capability.

It is another object of the invention to provide an x-ray tube which has improved brightness, power density, and instantaneous peak power.

It is another object of the invention to provide an x-ray tube which does not require bearing structures within the vacuum enclosure of the x-ray tube.

In accordance with these and other objectives of the invention, an x-ray tube is provided which includes a vacuum envelope in which is mounted a target anode for emitting x-rays. Also within the envelope is an electron gun for projecting an electron beam. The envelope is externally supported for movement. In a preferred embodiment of the invention, that movement is rotary. Means are provided for deflecting the electron beam along a predetermined, fixed path as the envelope rotates. While the envelope along with the target mounted therein is rotating, the electron beam traversing the fixed path strikes various portions of the target anode to distribute the heat load over the target area. In a preferred embodiment of the invention deflection of the electron beam along a fixed path is accomplished by magnetic deflection of the beam along the fixed path. In deflection is accomplished by use of a dipole magnet which is obtained, for example, by a pair of magnetic coils positioned externally to the envelope to provide a deflection field transverse to the electron beam. Other possible means of deflecting the electron beam are permanent magnets or electrostatic deflectors. Because the target anode is part of the vacuum envelope, the target anode can be rather easily cooled. The target means includes, for example, a tungsten laminate brazed to a TZM base which in turn is attached to form part of the vacuum envelope.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Reference will now be made in detail to the preferred embodiment of the invention, an example of which is illustrated in the accompanying drawings. While the invention will be described in conjunction with the preferred embodiment, it will be understood that it is not intended to limit the invention to that embodiment. On the contrary, the invention is intended to cover alternatives, modifications and equivalents, which may be included within the spirit and scope of the invention as defined by the appended claims.

Figure 1:
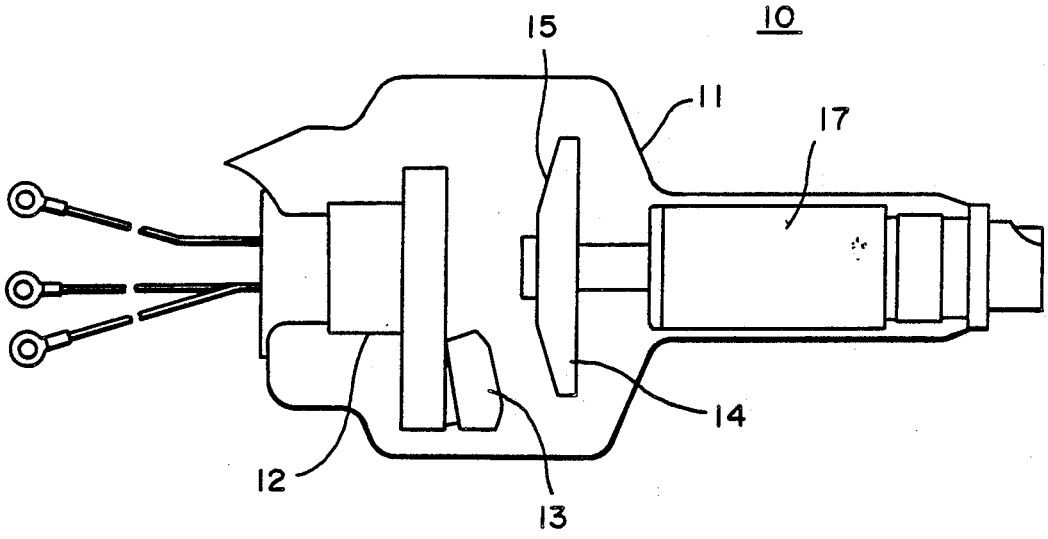
(PRIOR ART) FIG.— 1
FIG. 1 shows a prior art rotating anode x-ray tube.

FIG. 1 shows a well-known prior art x-ray tube 10 including a glass vacuum envelope 11 in which is mounted a cathode assembly 12 including an electron source 13. The electron source 13 provides an electron beam to a rotating anode 14, which is shaped as a disk having a slightly beveled target face 15 on which the electron beam strikes to emit x-rays, some of which exit the tube envelope 11 to be utilized externally. The rotating anode disk 14 is mounted at an end of a rod 16 which is rotatably supported within the vacuum by a motor and bearing assembly 17.

Figure 2:
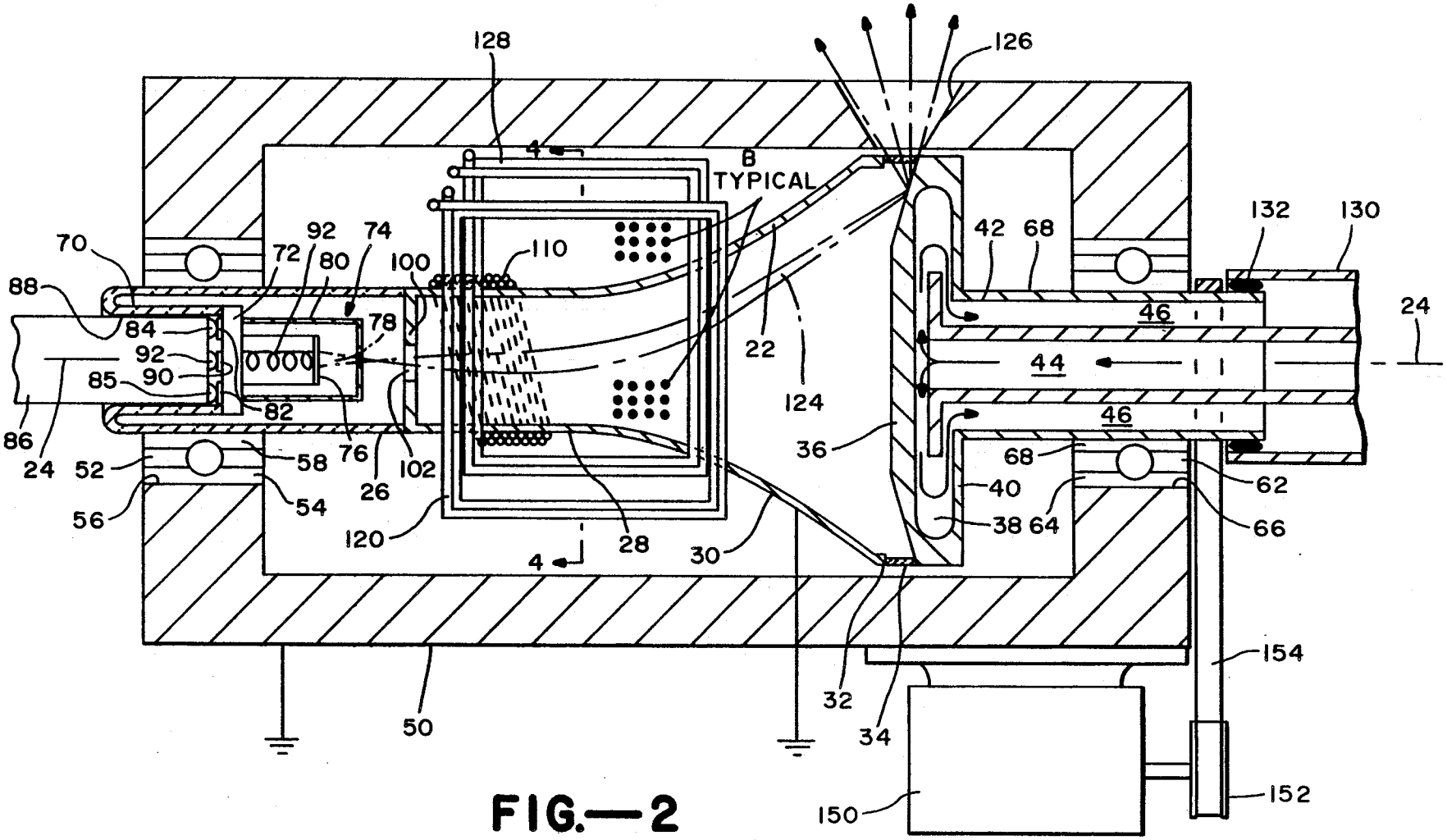
FIG. 2 shows a partially cross-sectional view of an x-ray tube rotatably mounted in a housing with a fixed magnetic field deflecting the electron beam along a fixed path as the x-ray tube rotates relative to the fixed magnetic field according to the invention.

FIG. 2 shows an embodiment of a rotating x-ray tube 20 according to the invention. An evacuated vacuum envelope 22 is provided which in a preferred embodiment of the invention is rotationally symmetrical about an axis 24.

The vacuum envelope 22 includes a hollow cylindrical glass neck portion 26. Attached to one end of the cylindrical portion 26 is a hollow cylindrical metal neck section 28 of a metal bell-shaped anode housing 30. The bell-shaped anode housing 30 is rotationally symmetric and progressively flares out in diameter as one moves away from its cylindrical neck portion 28. The bell-shaped anode is formed, for example, of a suitable material, such as stainless steel. The bell-shaped anode 30 terminates in a cylindrical lip 32 to which is fixed one edge of a cylindrical x-ray window ring 34. The other edge of the x-ray window ring 34 is fixed to a disk-shaped target anode 36. The x-ray window preferably has a substantially constant thickness and is formed from thin stainless steel or glass, or from iron, nickel, and cobalt compositions. Both the bell-shaped anode housing 30 and the target anode 36 are maintained at ground voltage potential. The target anode 36 is formed of a suitable material such as, for example, tungsten or, alternatively, is a composite structure known in the art for emitting x-rays. The target anode 36 has a hollow interior chamber 38 formed therein for passage of a cooling fluid. The external rear wall 40 of the target anode 36 has fixed thereto a hollow cylindrical axially-extending member 42 with two coaxial chambers 44,46 formed therein for passage of said cooling fluid respectively in and out of said hollow interior chamber 38 of said target anode 36.

A support frame 50 supports the vacuum envelope 22 for rotation about the axis 24. One end of the envelope 22 is journaled and supported for rotation by a first ball bearing assembly 52 which has its outer race 54 fixed in an aperture 56 formed in one end of the support frame 50. The inner race 58 of the bearing assembly 52 is fixed to the outer surface 58 of the cylindrical glass neck 26 of the vacuum envelope 30.

The other end of the envelope 22 is journaled and supported for rotation within the support frame by a second ball bearing assembly 62 which has its outer race 64 fixed in another aperture 66 formed in the other end of the support frame 50. The inner race 68 of the bearing assembly 62 is fixed to the outer surface 68 of the cylindrical axially extending member 42.

The glass neck portion 26 at the one end of the evacuated vacuum envelope 22 has fixed to an inner edge of a reentrant lip portion 70 a plug 72. Mounted on the plug 72 is an electron gun assembly 74 which includes an indirectly heated cathode 76 for generating an electron beam 78. A focusing electrode 80 provides a uniform acceleration field for the electron beam. A negative high voltage potential is supplied into the vacuum envelope to the cathode through conductors which pass through the plug 72 to the cathode 76. A slip ring 82 is connected to the conductors and makes sliding contacts with a pair of contacts buttons 84,85 connected to a high-voltage supply cable 86. The end of the cable 86 is journaled within an external cavity 88 formed within the glass neck portion 26 of the vacuum envelope 22 so that a negative high voltage is supplied through the slip ring 82 to the cathode 76 as the envelope 22 rotates within the frame 50. The negative high voltage is supplied, for example, from a fast switching-mode power supply (not shown) which is controlled to rapidly turn the electron beam 78 on or off as required. A center slip-connection pad 90 makes sliding contact with a contact button 92, which is connected through the cable 86 to a filament voltage potential, which floats on the negative high voltage. The pad 90 is connected through the plug 72 to one end of a cathode filament 92 with the other end of the cathode filament being connected to the cathode voltage.

Electrons are drawn from the region near the cathode 76 and accelerated by the electric field created between the cathode 76 and the anode housing 30. The end of the cylindrical metal neck portion 28 which is near the cathode includes an end plate 100 which extends perpendicularly to the axis 24 of the envelope. A central aperture 102 is formed in the end plate 100 to permit the accelerated electron beam to pass through. The electron beam may be focused to a tight waist just before it passes through the end plate aperture 102. A focusing solenoidal coil 110 may be positioned along the axis 24 near the aperture 102 for focusing the electron beam on the target anode 36. Because the metal anode housing 30 is at ground potential, the interior space of the anode housing 30 is field free and the accelerated electrons in the electron beam drift at high velocity toward the target anode 36.

Figure 4:
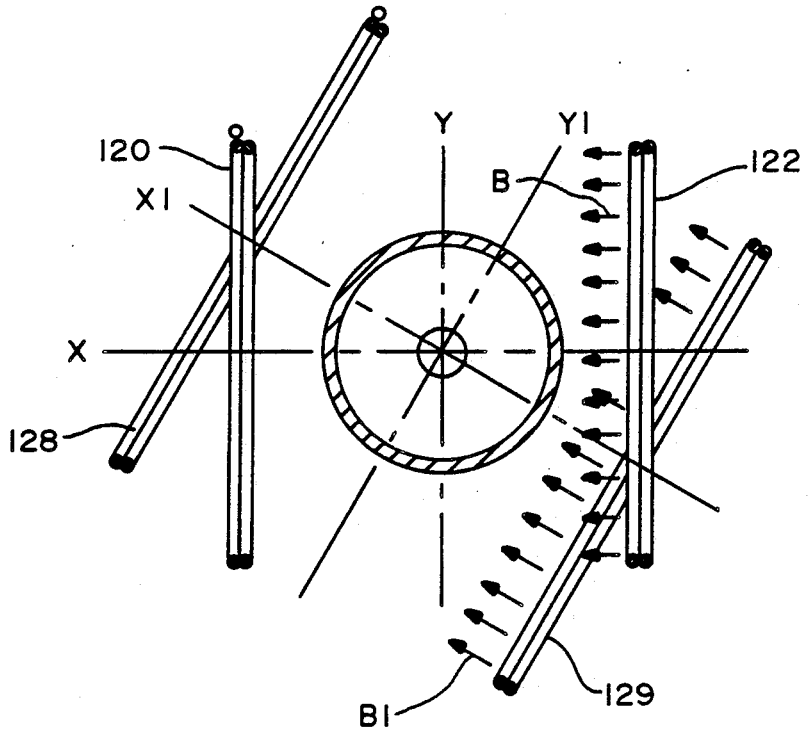
FIG. 4 is a cross-sectional diagram of an x-ray tube according to the invention taken along section line 4—4 of FIG. 3 and showing two pairs of coil windings each providing a dipole magnetic field for deflecting an electron beam along a respective fixed path.

FIGS. 4 and 2 show that a fixed magnetic deflection field B is provided by a pair of deflection coils 120, 122 fixed with respect to the support frame and located respectively on opposite sides of the cylindrical neck portion 28 of the anode housing 30. These coils are connected to constant current sources, not shown, and generate a constant magnetic field B transverse to the axis 24 of the tube. The constant magnetic field B deflects the electron beam so that the electron beam always travels along a fixed path 124 as the x-ray tube envelope rotates about the axis 24. The fixed path 124 can be visualized as being in a vertical plane if the deflection coils 120,122 are thought of as being in vertical planes to produce a B field in a horizontal direction. The deflection coils may also incorporate quadruple coils for shaping the electron beam focal spot on the target anode.

More generally, the magnetic field produced by the deflection coils 120 can be varied to deflect the electron beam along various selected paths, including the fixed path 124, such that the electron beam strikes other selected portions of the target anode. Other techniques are available for deflecting the electron beam along a fixed patch including alternative permanent-magnet magnetic deflection means and electrostatic deflection means.

The high-energy electron beam travelling along the fixed path 124 strikes the bevelled surface of the target anode 36 as the tube envelope rotates. X-rays are thereby produced and some of the x-rays exit the tube through the x-ray window 34 and an aperture 126 formed in the frame 50.

An alternate set of deflection coils 128,129 are provided in planes offset from the vertical. These coils are used to generate an alternative constant magnetic field B1, as shown in FIG. 4. The deflection coils 128,129 are in planes which are offset from vertical and produce the B1 field in a direction offset from the horizontal as shown in FIG. 4. Therefore, the path for an electron beam travelling through the B1 field will be in a plane which is at an angle to the vertical.

Figure 3:
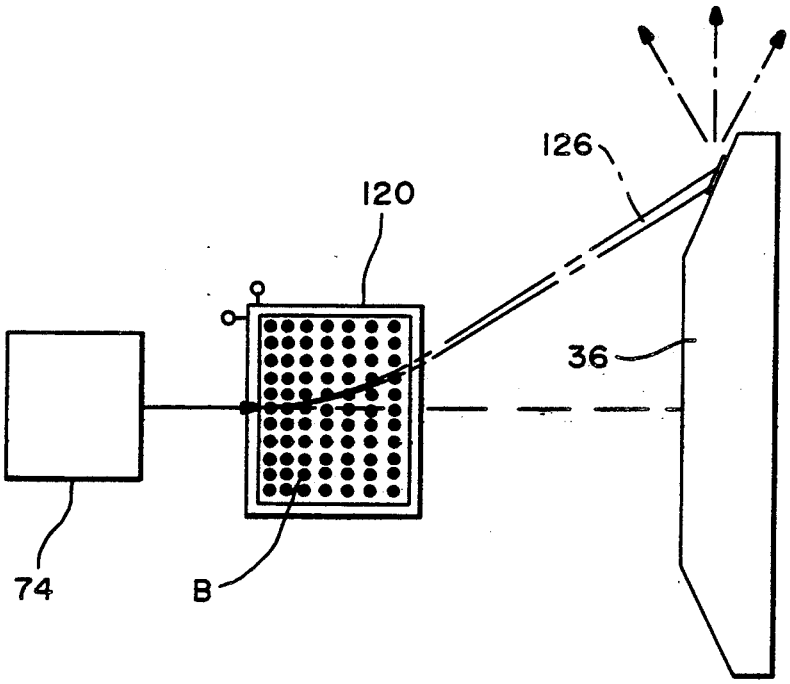
FIG. 3 is a schematic diagram of the principal components of an x-ray generator according to the invention.

FIG. 3 schematically shows an electron gun 74 projecting an electron beam toward a target anode 36. The electron beam is deflected along a fixed path 124 by a transverse magnetic field B deflection means produced by a pair of deflection coils as indicated by one of the coils 120. FIG. 2 indicates that heat generated by the electron beam striking the target anode 36 is removed by a cooling fluid such as water, oil, or a gas, which is directed through the chamber 44 and along the back side of the grounded target anode and out through the chamber 46. The far end of the cylinder 42 is coupled via a rotating seal to a fixed coaxial inlet/outlet conduit 130 for cooling fluid.

Figure 5:
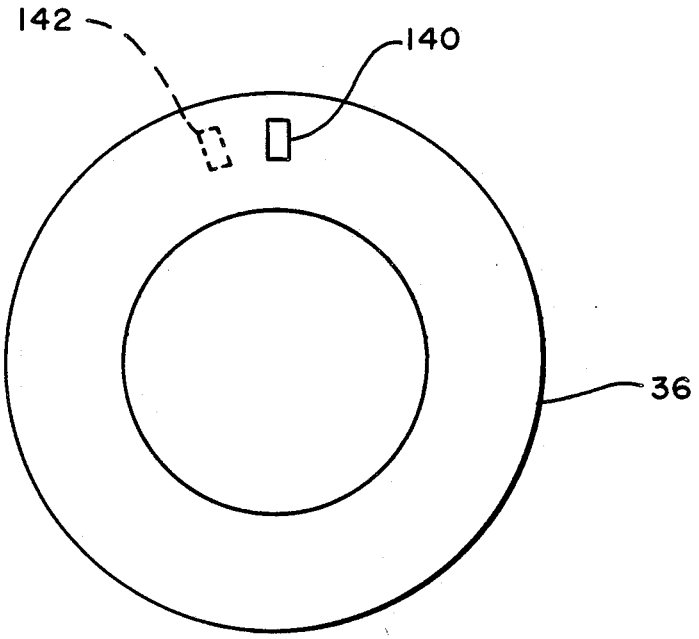
FIG. 5 shows the surface of a target anode.

FIG. 5 shows a face view of the target anode 36. The first focal spot location 140 shows the location of the electron beam as it impinges upon the target when the first set of focusing coils 120,122 are used. When the alternate focusing coils 128,129 are used, the offset focal spot location 142 is produced. This permits the focal spot position to be moved. Applications of the movable focal point permit two separate focal spots or sources of x-radiation to be used, for example, to increase the spatial resolution in a CT scanner.

In operation the envelope is rotated at an appropriate speed depending on the target anode design and the operational heat load. The envelope 22 is rotated by using a suitable drive motor 150 fixed to the frame 150. The motor 150 is coupled to the external end of the member 42 with an appropriate coupling means including, for example, a pulley 152 driving a belt 154 or a gear train (not shown). Alternatively, the envelope 22 is rotated by including suitable vanes (not shown), within the fluid chambers of the anode, which vanes are driven by the coolant fluid to rotate the envelope.

The foregoing descriptions of a specific embodiment of the present invention have been presented for purposes of illustration and description. It is not intended to be exhaustive or to limit the invention to the precise forms disclosed, and obviously many modifications and variations are possible in light of the above teaching. The embodiment was chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents

We claim:

1. An x-ray tube comprising:

an envelope for containing a vacuum;

a target means mounted within said envelope for emitting x-rays;

an electron beam accelerator assembly including:

an indirectly heated cathode means for emitting an electron beam; a primary anode plate having formed therein an aperture through which the electron beam is accelerated and means for focusing said electron beam on said target means;

support means external of said envelope for supporting said envelope for rotational movement; and means for deflecting said electron beam along a selected path as said envelope rotates such that said electron beam strikes selected portions of said target means mounted within said envelope as said envelope rotates.

2. The x-ray tube of claim 1 wherein said means for deflecting said electron beam deflects said election beam along a fixed path as said envelope rotates.

3. The x-ray tube of claim 1 wherein said deflecting means include first means for magnetically deflecting said electron beam along a first fixed path.

4. The x-ray tube of claim 1 wherein said envelope contains an x-ray window for transmitting x-rays emitted from said target within said envelope as said electron beam strikes said target.

5. The x-ray tube of claim 3 wherein said means for magnetically deflecting said election beam along a selected path includes dipole magnetic means for deflecting said electron beam.

6. The x-ray tube of claim 5 wherein the dipole magnetic deflecting means includes a pair of magnetic deflection coils positioned externally of said envelope to provide a deflection field transverse to the electron beam for deflection of said electron beam along a selected path as said envelope is rotated.

7. The x-ray tube of claim 3 including second means for magnetically deflecting said electron beam along a second selected path to said target means.

8. The x-ray tube of claim 1 wherein said target means has portions outside of said envelope and adapted for cooling said target means.

9. The x-ray tube of claim 8 wherein said target means includes means for fluid cooling said target means.

10. The x-ray tube of claim 1 wherein said support means includes rotary bearing means for externally supporting said envelope.

11. The x-ray tube of claim 1 wherein the means for focusing said electron beam on said target means includes a solenoid positioned coaxial with said electron beam.

12. The x-ray tube of claim 1 wherein the means for focusing said electron beam on said target means includes means for focusing the electron beam to a tight waist before the electron beam enters the aperture in the primary anode plate.

13. The x-ray tube of claim 12 wherein said means for focusing the electron beam to a tight waist includes a focusing electrode positioned between said cathode means and said primary anode plate for providing a uniform acceleration field for said electron beam.

* * * * *